US006472589B1

(12) United States Patent
Lee

(10) Patent No.: US 6,472,589 B1
(45) **Date of Patent: *Oct. 29, 2002**

(54) METHOD AND APPARATUS FOR SENSING, CONTROLLING AND RECORDING KEY MOTION IN A KEYBOARD MUSICAL INSTRUMENT

(75) Inventor: Charles R. Lee, Placerville, CA (US)

(73) Assignee: Overture Music Systems, Inc., Elizabethtown, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/482,484

(22) Filed: Jan. 12, 2000

Related U.S. Application Data

(60) Provisional application No. 60/115,612, filed on Jan. 12, 1999.

(51) Int. Cl.[7] ..... G10F 1/02; G10G 3/04

(52) U.S. Cl. ..... 84/21; 84/462; 84/DIG. 7

(58) Field of Search ..... 84/615–620, 626–633, 84/639–643, 688, 658, DIG. 7, 20–22, 115, 462

(56) References Cited

U.S. PATENT DOCUMENTS

| | | | | | |
|---|---|---|---|---|---|
| 3,590,134 | A | * | 6/1971 | Ogi | 84/688 |
| 3,594,488 | A | * | 7/1971 | Ohno | 84/688 |
| 3,617,600 | A | | 11/1971 | Ohno | |
| 4,151,774 | A | | 5/1979 | Klann | |
| 4,213,367 | A | | 7/1980 | Moog | |
| 4,366,463 | A | | 12/1982 | Barker | |
| 4,838,139 | A | | 6/1989 | Fiori, Jr. | |
| 5,237,123 | A | * | 8/1993 | Miller | 84/21 |
| 5,237,125 | A | | 8/1993 | Fields | |
| 5,451,708 | A | | 9/1995 | Fujiwara et al. | |
| 5,469,772 | A | | 11/1995 | Vandervoot | |
| 5,505,115 | A | | 4/1996 | Vandervoot | |
| 5,567,902 | A | | 10/1996 | Kimble et al. | |
| 5,648,621 | A | | 7/1997 | Sasaki | |
| 5,648,630 | A | | 7/1997 | Vandervoot | |
| 5,726,374 | A | | 3/1998 | Vandervoot | |
| 5,783,765 | A | * | 7/1998 | Muramatsu | 84/615 |

* cited by examiner

*Primary Examiner*—Stanley J. Witkowski

(57) ABSTRACT

A device and related method for detecting, controlling, and recording keyboard motion in which individual magnets, sensors and actuators associated with each key capture and re-produce key motion with a high degree of accuracy. The method uses a non-contact sensing assembly technique that requires no mechanical or electrical connections with the keyboard assembly, thus making the device easy to service and install. The method also uses a mathematical algorithm to adjust actuator key movement at a very rapid rate making it possible to install in a variety of pianos with different key weights and still be able to play with high accuracy. Finally, the device system dynamically maps the keyboard to which keys are in playback mode and which are in record mode, allowing the use of both modes simultaneously, thus letting the player add to (layer) performances.

19 Claims, 10 Drawing Sheets

Fig. 2
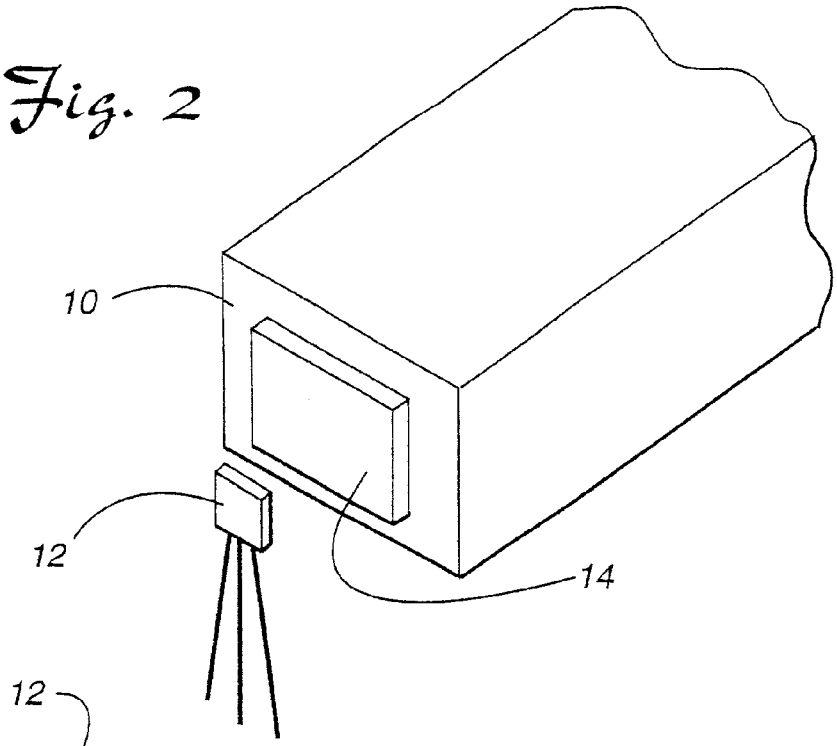
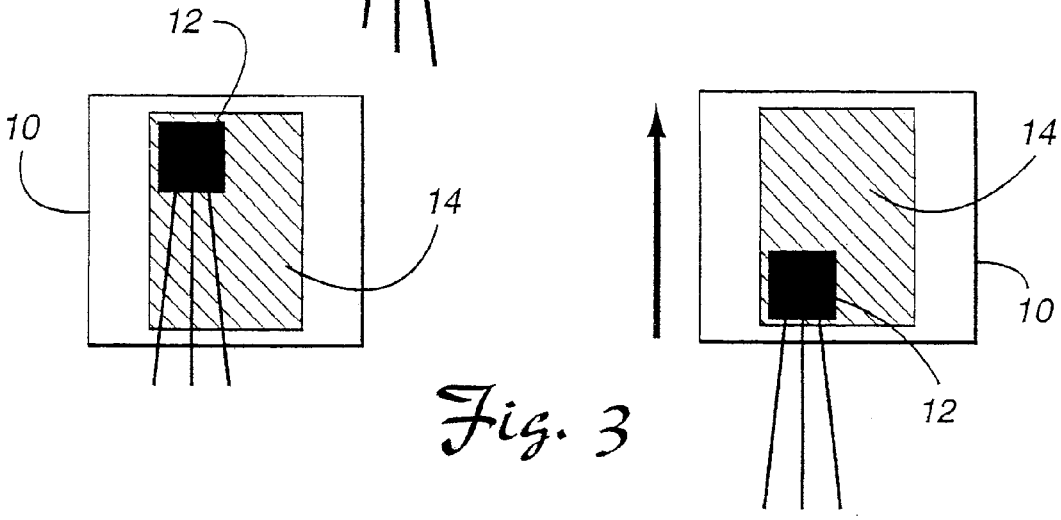
Fig. 3
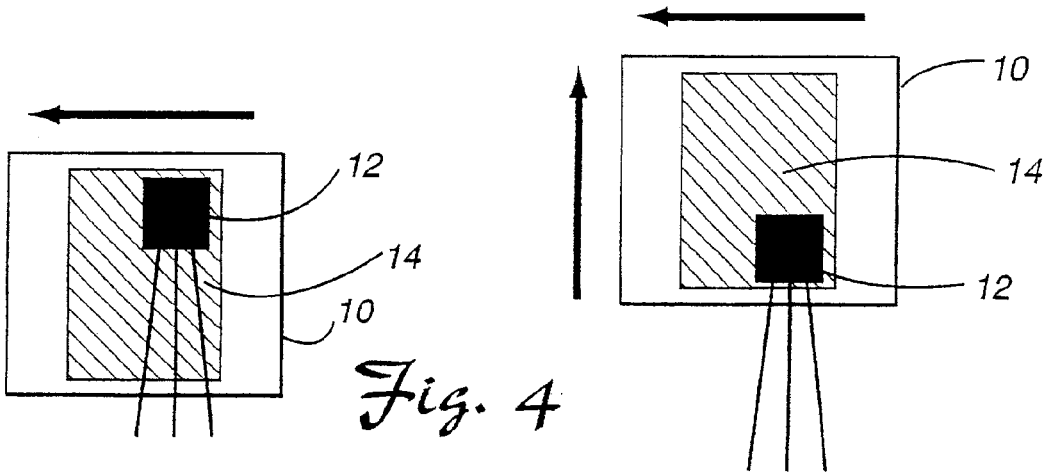
Fig. 4

TMS320C240 DSP

TMS320C240 DSP

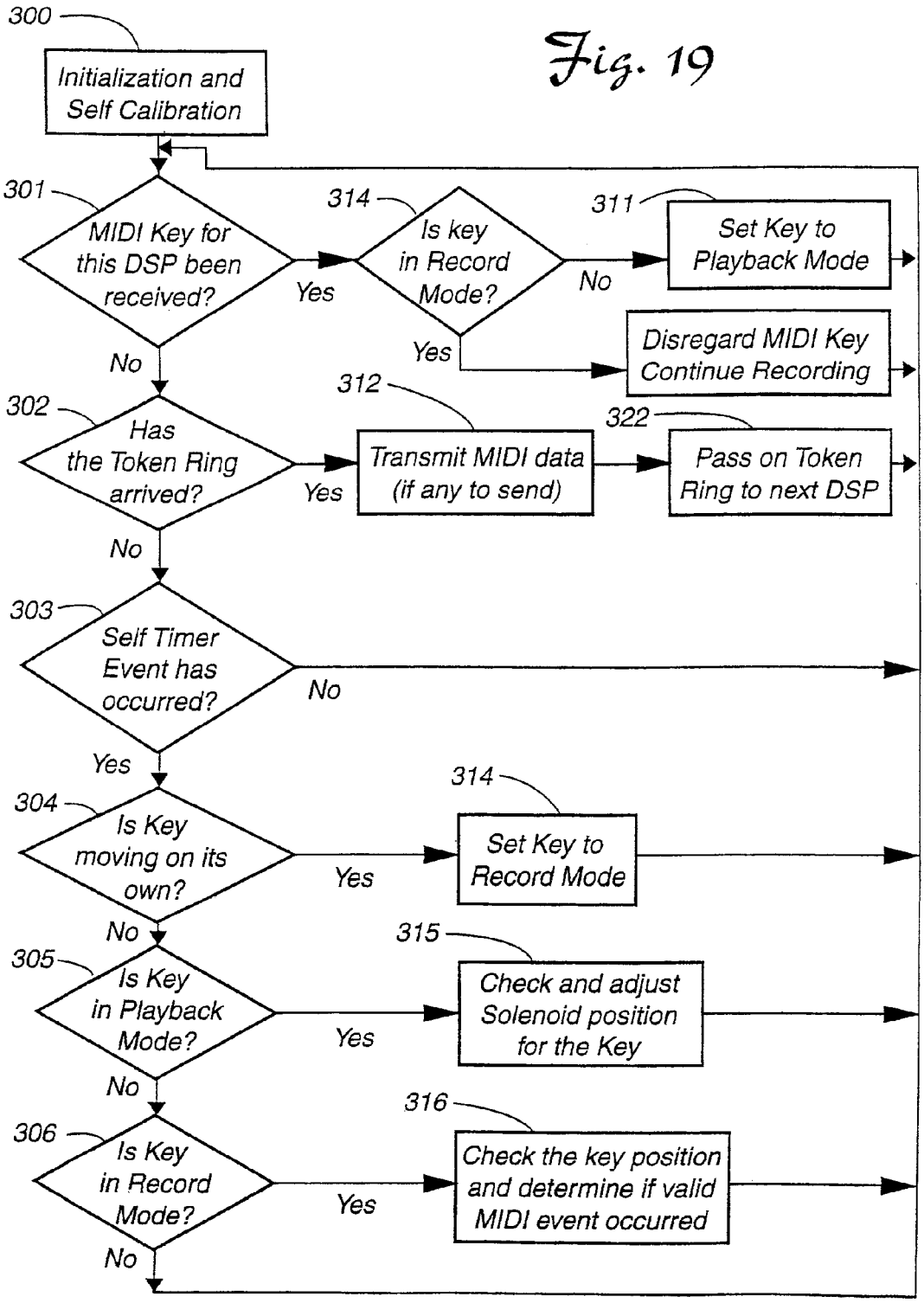
Fig. 19
300
Initialization and Self Calibration
301
MIDI Key for this DSP been received?
Yes
No
314
Is key in Record Mode?
No
Yes
311
Set Key to Playback Mode
Disregard MIDI Key Continue Recording
302
Has the Token Ring arrived?
Yes
No
312
Transmit MIDI data (if any to send)
322
Pass on Token Ring to next DSP
303
Self Timer Event has occurred?
No
Yes
304
Is Key moving on its own?
Yes
No
314
Set Key to Record Mode
305
Is Key in Playback Mode?
Yes
No
315
Check and adjust Solenoid position for the Key
306
Is Key in Record Mode?
Yes
No
316
Check the key position and determine if valid MIDI event occurred

METHOD AND APPARATUS FOR SENSING, CONTROLLING AND RECORDING KEY MOTION IN A KEYBOARD MUSICAL INSTRUMENT

This application claims the benefit of U.S. Provisional Patent Application Serial No. 60/115,612, filed Jan. 12, 1999, Charles R. Lee, entitled METHOD AND APPARATUS FOR CONTROLLING AND RECORDING KEYBOARD MOTION IN A MUSICAL INSTRUMENT.

TECHNICAL FIELD

The present invention relates to the field of keyboard musical instruments, and more particularly to an apparatus and related method for accurately detecting, controlling and recording key movement and velocity.

BACKGROUND OF THE INVENTION

Generally musical performances can be recorded either for sound through analog audio recordings, or in a digital format such as Musical Instrument Digital Interface (MIDI) which stores the actual notes including velocities and duration of key movements in digital format. The MIDI standard has been around for several years, and is widely adopted by the music industry.

There are many devices on the market which allow the piano/keyboard to record MIDI output from a performance, and to play music recorded in a MIDI format from an external source such as another keyboard, a computer or a MIDI sequencer. Unlike electronic keyboards which have internal sound generators (synthesizers), the piano must create sound by the key's hammer hitting the string. Thus, the sound can be created by a performer playing the piano keys or by a mechanical/electromechanical method used to actuate the keys.

Player pianos have been around for decades, first starting as strictly mechanical devices and then more recently evolving to electromechanical devices. Music recorded in a MIDI format is often used as the main information to play notes in such pianos and can describe 127 different velocities (actually 128 if you include the "velocity" of the note not playing at all) for each key on the piano keyboard.

When using MIDI, there are several bytes of information that are transmitted every time a key is pressed or released. Generally, when a key is pressed, three bytes are transmitted, including: (1) Note On; (2) Key Number; and (3) Velocity (of that key). Likewise, when a key is released, three additional bytes are transmitted including: (1) Note Off; (2) Key Number; and (3) Velocity (of the key being released).

Unfortunately, these and similar mechanical and electromechanical devices are not as precise as the MIDI levels used to describe a music performance. Ambient conditions such as temperature, humidity, and other environmental factors can cause the performance of these devices to be altered or drift over time. For example, as a solenoid is used throughout a musical performance, its own internal temperature can increase changing its performance characteristics in addition to the noted effect of other ambient conditions. The internal rise in temperature is directly related to the operation of the solenoid in accordance with the music being played, and creates an unsatisfactory result for manufacturers.

The present invention seeks to significantly reduce, if not eliminate, this problem through continuous monitoring of the movement and velocity of the keys being actuated by a musician or mechanical or electromechanical device such as a solenoid for improved recording or for determining and adjusting the key's velocity if the velocity is not within the specified limits or at the desired MIDI velocity. Internal tables may be used for comparison, and if the key's movement and/or velocity is unsatisfactory, adjustments may be made. Several comparisons and adjustments can be made before a hammer associated with the actuated key strikes the piano string.

SUMMARY OF THE INVENTION

Accordingly, it is a primary object of the present invention to provide a novel and improved device and related method that are particularly adapted to detect, control, and record key movement and velocity in a keyboard musical instrument.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, there is provided an improved device capable of detecting, controlling and recording the movement and velocity of a key of a keyboard musical instrument during a first mode of operation, i.e., recording, or a second mode of operation, i.e., playback. In accordance with the broadest teachings of the present invention, the device and related methods may be applied to digital pianos, electronic keyboards, or other musical devices that are capable of generating sounds by pressing a button or key. However, the description that follows will focus primarily on the invention as it pertains to an acoustic piano.

In general, keyboard key velocities range from very slow (hundreds of milliseconds) to very fast (about 20 milliseconds) and are defined as the time from when the key is first actuated to when the hammer of the key strikes the corresponding string.

A standard piano keyboard has 88 keys and three foot pedals. To accurately monitor the key's movement and velocity and make adjustments if needed, the device measures and responds to any deviation within a very short duration of time, preferably less than one millisecond. This is due to the fact that the position of the key being monitored can change very fast for a loud/hard note, for example, and any information acquired is old if not quickly acted upon.

In accordance with the present invention, the 88 keys and three pedals of a typical keyboard are monitored using a magnetic sensor, and a digital signal processor (DSP) or microprocessor. As each key moves independently from other keys, the task can be further broken down into small groups of keys that are controlled or monitored by one or more microprocessors, DSPs, or preferable, each DSP operates independently, constantly monitoring the keys within its group for movements and determining the accuracy of the movement or velocity. The number of keys that a processor can control can very depending on the capabilities of the processor including its ability to handle measurements quickly, but it is preferred that the number of keys controlled would be thirty or less for each processor. As such, the number of processors in a piano would start with a minimum of three.

The piano can exist in two modes; playback and record. In playback mode, the keys are driven by an actuator in accordance with an external MIDI player causing the notes on the piano to play by themselves. In record mode, someone is physically actuating the keys and generating the MIDI information based on their performance.

Since the processor controls the keys during playback, it also knows which keys within its groups of keys are not being used. These keys that are not being used can be made available for recording even though other keys are being used in playback. This gives the additional feature of a pianist being able to record on top of a song that is being played back. An example of the utility of this feature is self-recorded duets. Specifically, the second half of a duet can be recorded on top of a first, previously recorded part during its playback. This feature is referred to as "simultaneous playback and recording" later in this document.

An additional feature is the fact that due to the independent monitoring of keys, and specifically the parallel computing nature of the preferred embodiment, typical keyboard scanning errors are significantly reduced if not removed altogether. Most keyboards use serial scanning to determine which keys are being played. Serial scanning entails monitoring each key in a sequential fashion from one key to the next, through all 88 keys. Once completed, scanning resumes from the beginning. In this manner, scanning errors are often introduced into the system. Scanning errors result, for example, when a performer plays a key just after the note has been scanned, and thus the key's movement is not captured until the key is next scanned, i.e., following the scanning of the other 87 keys. This kind of error can result in the incorrect measurement and recording of MIDI velocities. Although the problem can be somewhat reduced by increasing the scanning rate, the present inventive method of monitoring keys preferably through parallel computing techniques, errors are reduced significantly if not eliminated since each key is continuously monitored for techniques, significantly reduces, if not eliminates, the changes.

Accordingly, several advantages are offered by the present invention, including: (1) improved accuracy in playback mode is achieved since adjustments can be made while the actuator is moving the key towards the string; (2) automatic switching between playback and recording modes; (3) the utilization of both playback and recording modes of operation at the same time based on the dynamic allocation between the two modes as required; (4) precise timing and individualized monitoring analysis of each key movement; (5) continuous monitoring and adjustment/self-calibration of the actuator; (6) protection against damage to a seized or frozen actuator through automatic shut-down; and (7) the if capability to further monitor additional keyboard recording information (Aftertouch) by monitoring the backcheck position of the key after the key has been fully pressed, and issuing an additional signal if additional pressure is exerted on the key during this time.

Still other objects of the present invention will become apparent to those skilled in this art from the following description wherein there is shown and described the preferred embodiments of this invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive

BRIEF DESCRIPTION OF THE DRAWINGS

The accompanying drawings incorporated in and forming a part of the specification, illustrates several aspects of the present invention, and together with the description serves to explain the principles of the invention. In the drawings:

FIG. 2 is an illustrated view showing the preferred placement of the sensor and associated magnet in relation to the rear portion of the key;

FIG. 3 is an illustration of the typical movement of the rear portion of the key and the magnet relative to the sensor;

FIG. 4 is an illustration of the possible side-to-side movement of the rear portion of the key relative to the sensor;

FIG. 19 is a flowchart of the algorithm used to differentiate between the record and playback modes for each key, and when to monitor key movement.

DETAILED DESCRIPTION OF THE INVENTION

It will be appreciated that the invention may vary as to configuration and as in details without departing from the basic concepts as disclosed within.

Figure 1:
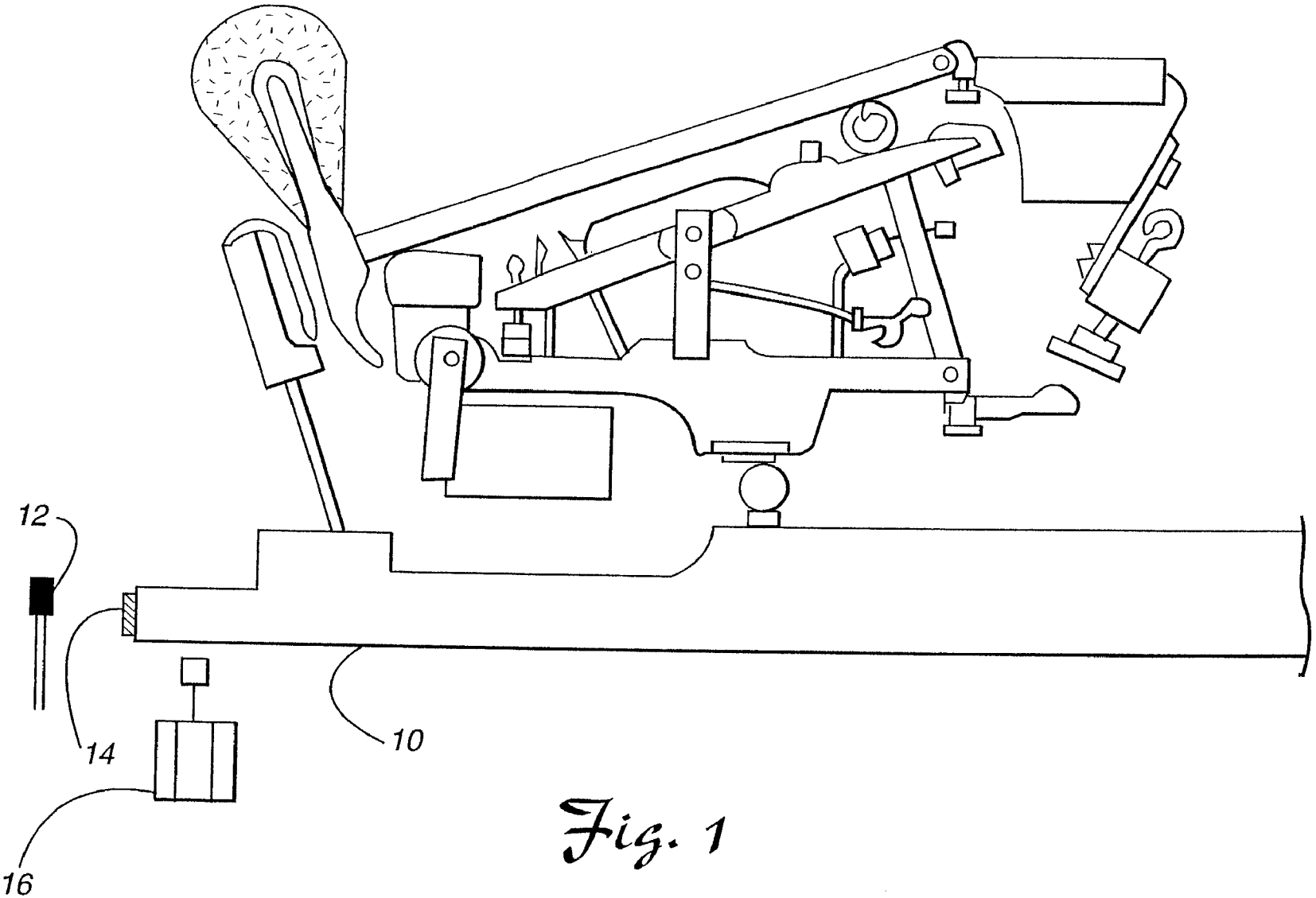
FIG. 1 is a side elevational view of the an acoustic piano mechanism and also showing an actuator, magnet and sensor.

With reference to FIG. 1, there is shown a device for measuring the relationship of the key 10 to the sensor 12. The sensor 12 is magnetic, sometimes referred to as a "Half Effect Sensor," and senses the movement of the key 10 as it moves past the sensor. The magnetic sensor 12 is supported by a key board musical instrument (not shown) adjacent to and a substantially constant distance away from a magnet 14 for sensing movement of the magnet and producing an electrical signal corresponding to the movement.

In the present preferred embodiment, the magnet 14 is polarized in the vertical direction. Accordingly, as the key 10 moves upwards the polarity that the sensor 12 detects gradually changes from one polarity to the other. This method is often referred to as the "slide-by" method of measuring magnetic strength and polarity. The advantage of utilizing this method is that the sensor 12 remains in one magnetic field (unaffected by adjacent keys" and also gives an almost full range output from the sensor (the other type of sensing—known as "Head-on" gives only ½ full range of output). More output means better resolution of key movement.

With reference to FIG. 2, there is shown a view of the rear portion of the key 10, the magnet 14 mounted to the rear portion of the key, and the relationship of the sensor 12 to both the magnet 14 and the key 10. The key 10 moves in a vertical direction in front of the sensor 12, while the sensor remains stationary.

In the examples to follow and the present preferred embodiment, the South pole of the magnet 14 is on the upper side, and the North pole of the magnet is on the lower side. This gives an increasing voltage as the key 10 and magnet 14 rise upwards. Reversing the poles (flipping the magnet over) inverts the sensor output, but in no way changes the patent issues covered within the document.

With reference to FIG. 3, there is shown a key 10 at rest in front of the sensor 12. As the key 10 moves upward, the magnet 14 moves in front of the sensor 12, and the polarity of the magnet that the sensor detects, also changes with the movement. The polarity gradually shifts from the South pole to the North pole, and the corresponding voltage output changes with the voltage.

Note that the sensor 12 is positioned on the left side of the magnet 14 on the key 10. This is done to account for the fact that the key 10 can shift sideways when the Soft pedal is pushed (shown in FIG. 4). At rest the key 10 can move 3/16" (4 mm) sideways when the Soft pedal is pressed. When the key 10 is pressed while the soft pedal is also pressed, the key 10 will move upwards but physically shifted to the left (looking from the rear portion of the piano). This is why for this invention, the magnet 14 must have a width of ¼– (6 mm) or greater to account for this shift. When the soft pedal is released, the key 10 will return to its normal position, and the sensor 12 will be aligned over the left side of the magnet 14 again.

Figure 5:
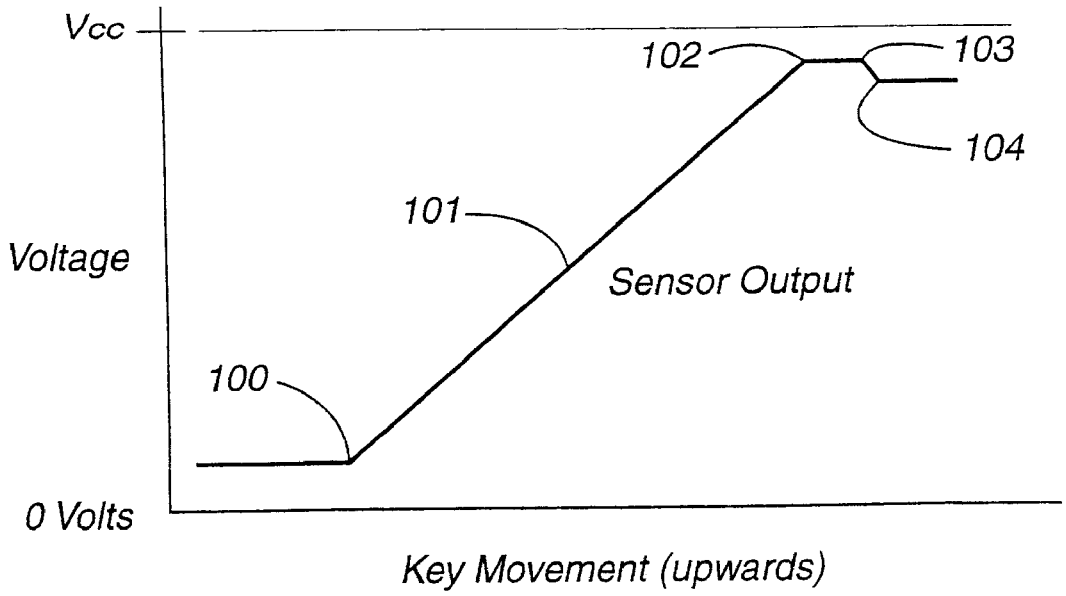
FIG. 5 is a graphical representation of a typical sensor output when a key is actuated (rear portion of the key raised)

Referring to FIG. 5 shows a typical output of the sensor 12 while a key 10 is being pressed. The key 10 is at rest until at 100 where it first starts traveling upwards in front of the sensor 12. As the key 10 moves, the South pole of the magnet 14 gradually gets weaker as it shifts towards the North pole. At midway 101, the strength of the poles are about equal, and the sensor 12 detects no field, as the South pole and North pole cancel each other out. It is at this point that the sensor 12 outputs ½ Vcc (the supply voltage), which is also the same voltage it outputs if there was no magnetic field at all.

As the magnet 14 continues sliding by the sensor 12, the North pole has the dominant strength and becomes stronger until the key 10 is fully pressed 102 with the North pole directly over the sensor 12. This gives the highest voltage output from the sensor 12. Due to the mechanical nature of the piano key. The key 10 enters "backcheck" 103 mode, where the key moves slightly downwards, causing a slight shift in the output shown at 104. This slight shift in output can be used to further evaluate the key's position, and how it is being played.

Note that the response of the sensor 12 produces a fairly linear ramp (line) as the key 10 moves upward. This is a unique characteristic of the Slide-by approach, unlike the Head-on approach which produces an exponential curve. This is due to the fact that the sensor 12 maintains a constant distance from the magnet 14, so magnetic field strength is constant, unlike Head-on where the field strength increases exponentially.

Figure 6:
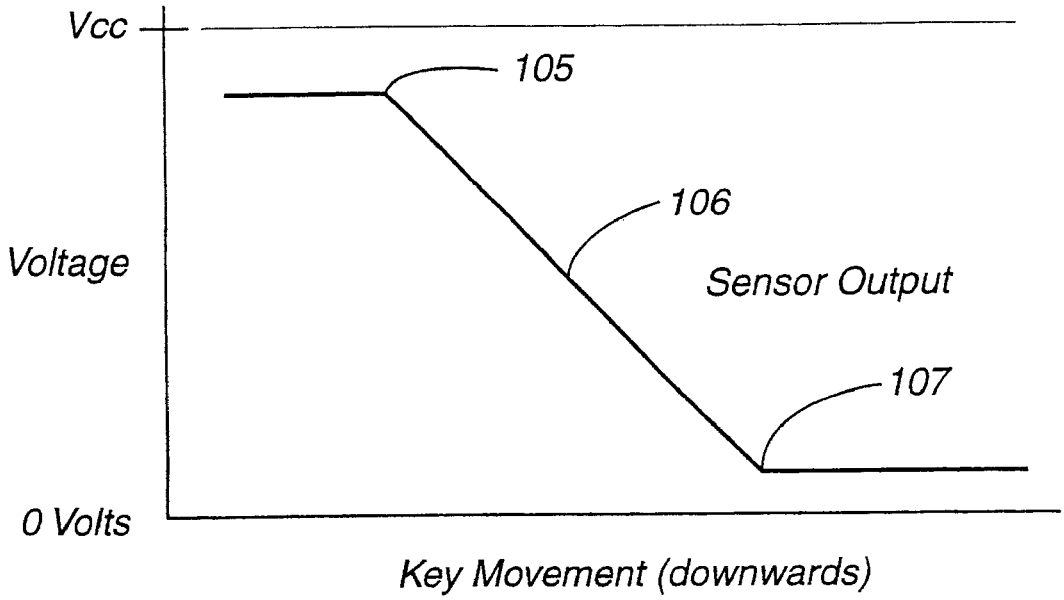
FIG. 6 is a graphical representation of a typical sensor output when a key is released (rear portion of a key lowered)

Referring to FIG. 6, the diagram shows the process of the key 10 being released. At 105, the key 10 starts its downward movement from the backcheck position (on electronic keyboards, there would be no backcheck position). As the polarity of the magnet 14 changes from the North pole to the South pole, it crosses the intermediate point 106 where both fields cancel each other out (again at ½ Vcc output). Beyond this point, the South pole of the magnet 14 has the greater strength and gradually increases until at 107 the key 10 is fully released and the sensor 12 sits over the South pole of the magnet 14.

Figure 7A:
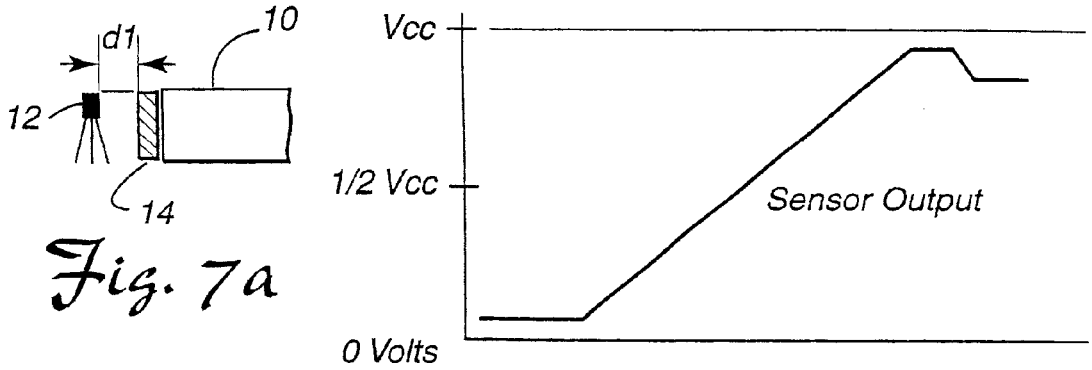
FIG. 7*a* is a graphical representation of the sensor output when optimally positioned relative to the magnet and key (shown here at rest)

Due to the mechanical nature of the installation of the sensors, the sensor 12 may not always be placed at the ideal position shown in FIG. 7*a*. It can be mounted further away from the key 10 than what it should be, or offset in a vertical direction (up or down). Because of the width of the magnet 14, a horizontal offset has no effect (unless it is well past the magnet).

In the ideal position in FIG. 7*a*, the sensor 12 is placed correctly in both distance from the magnet 14 and over the end of the magnet where the South pole is the strongest. This gives the best output from the sensor 12.

Figure 7B:
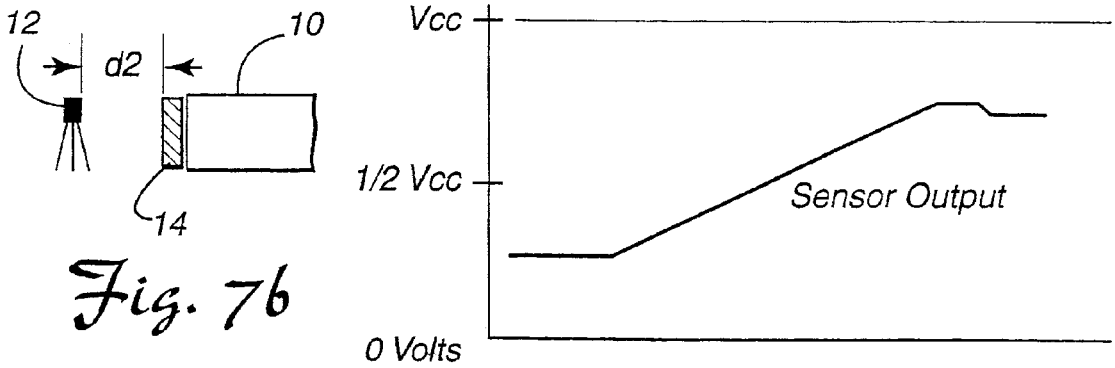
FIG. 7*b* is a graphical representation of the sensor output when the sensor is positioned further away (than the ideal position) relative to the magnet and key.

If the sensor 12 is mounted away from the magnet 14 as shown in FIG. 7*b*, the larger distance d2 will cause the sensor to detect a weaker magnetic field, and thus output a corresponding weaker signal. The shift in output is centered over ½ the supply voltage to the sensor ½ Vcc). As noted above, this point corresponds to a point where the South pole and North pole effectively cancel each other out leaving no effective polarity. It is both extremes of the output that get reduced as the sensor 12 is moved further away, with the sensor's output gradually compressing (seeing less magnet field) towards the mid-point ½ Vcc—not magnetic field).

Figure 7C:
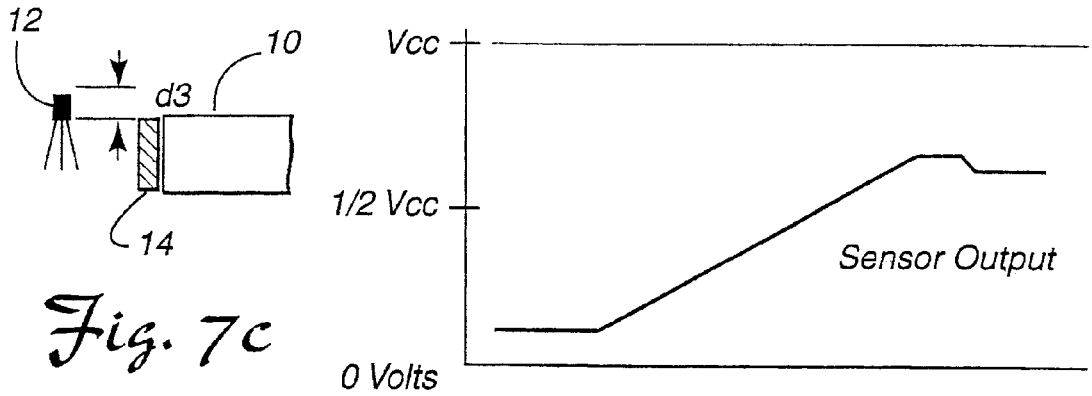
FIG. 7*c* is a graphical representation of the sensor output when the sensor position is too low relative to the magnet and key.
Figure 7D:
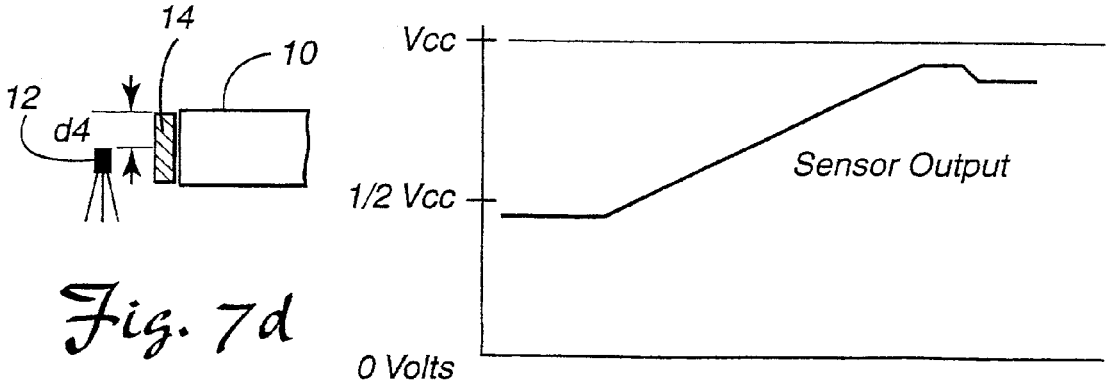
FIG. 7*d* is a graphical representation of the sensor output when the sensor position is too high relative to the magnet and key.

Another possibility is that the sensor 12 can be mounted too high d3, as shown in FIG. 7*c*, which shifts the output of the sensor 12 downwards, as the sensor will never see the full strength of the North pole. Likewise, the sensor 12 could be mounted too low d4, as shown in Figure 7*d*, giving a shifted output towards the higher voltages as the sensor never sees the full strength of the South pole.

These variations can be compensated by applying an algorithm to correct any offsets. Nothing that ½ Vcc is the midway point (no magnetic field), and is also the center point of the key 10 traveling up or down, it is thus the known point of reference. Any full key movement must pass that point when the key 10 is midway.

An ideal response would have the voltage range from 0 volts to Vcc (the supply voltage). At rest, the sensor output should be 0 volts, and during the highest point, the sensor 12 should have the voltage of Vcc. With these three points (Rest, Midway and Fully Depressed Key), a formula can be applied to correct the shifted output.

Figure 8:
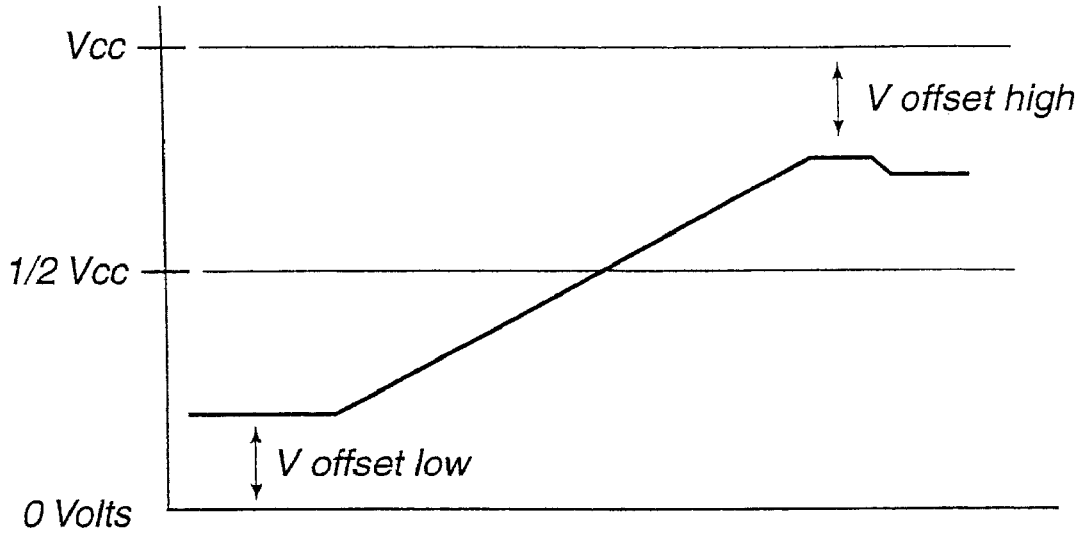
FIG. 8 is a graphical representation of the portions that are used in the algorithm to remove any sensor placement offsets during installation.
Figure 9:
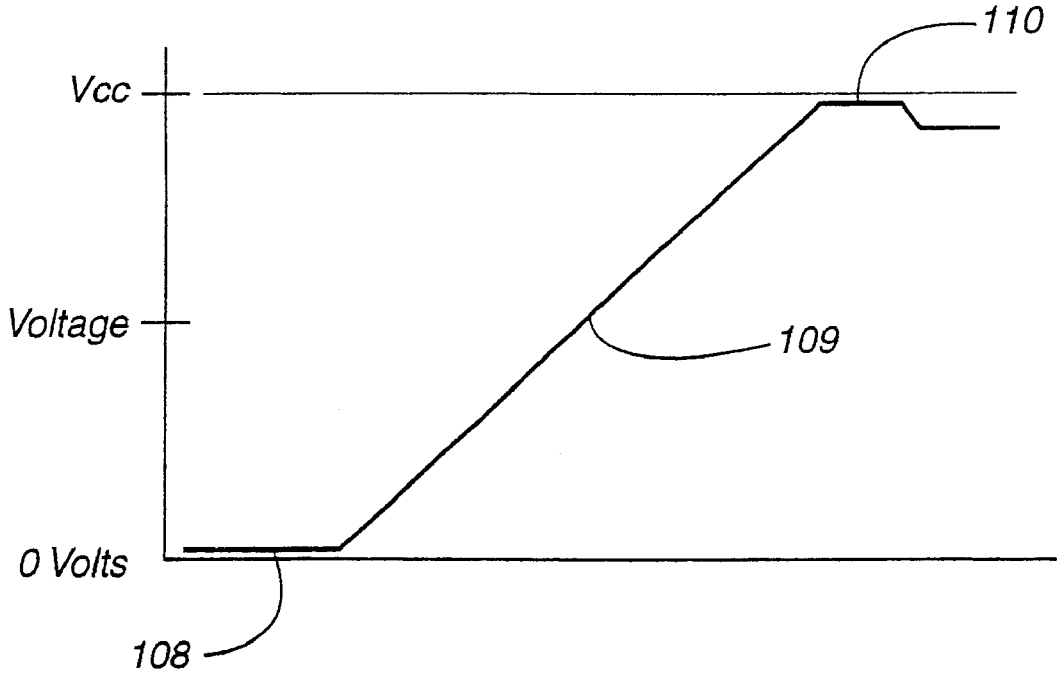
FIG. 9 is a graphical representation of the corrected and normalized sensor output after being adjusted by the algorithm.

Referring to FIG. 8, the two offset voltages (V offset low, and V offset high) must be identified. This can be done during a calibration mode, after the sensors 12 are installed. A technician (or the end user) can put the electronics into calibration mode, and then press each key 10 individually. A microprocessor or DSP can then measure how high the sensor's output goes (V offset high), and what it is at rest (V offset low). Knowing these two values and the required value of halfway ½ Vcc) yields a formula that can normalize the sensor's output.

First, any low offset must be removed, so the sensor's output at rest will equal 0 Volts. Then the resulting value must be multiplied by a normalizing figure to yield a full scale response. The formula is as follows:

Corrected data=(sensor data−low offset)×(ideal full range/actual full range)

Or referring to the graph in FIG. 8:

$$\text{Corrected data} = (\text{sensor data} - \text{V offset low}) \times \frac{\text{Vcc}}{(\text{V offset high} - \text{V offset low})}$$

Testing has shown this formula to work in normalizing all sensor data outputs. The error rate is small for small variations in sensor mounting, gradually increasing in error rate as the error in sensor mounting increases. The net effect though is that within reason, the sensor variations are corrected and normalized properly, giving a consistent output range from sensor to sensor. A normalized output curve is shown in FIG. 8. The algorithm can be easily implemented in a microprocessor or DSP (not shown) which may also be utilized to monitor the outputs of the sensors 12.

Figure 10:
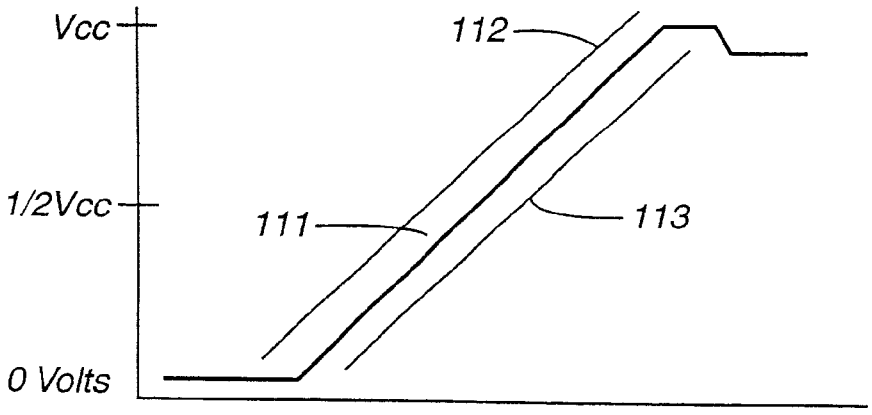
FIG. 10 is a graphical representation of the correction window around the sensor output as the solenoid moves upwards.

Referring to FIG. 10 shows the error correction window that the solenoid performance is evaluated by. An ideal response of key movement produced by a driving solenoid 16 is shown by 111. The maximum error for the solenoid 16 being too low is shown by 113.

Within these two limits 112 and 113, the DSP is allowed to try to correct the movement of the solenoid 16 by a variety of algorithms. This includes scaling back or boosting the drive pulses depending on how much correction is needed positive or negative. Algorithms for correction include look-up tables, in which the correction is based on the magnitude of the error (positive or negative), and vector analysis where two points (previous position and current position) from a vector showing the velocity of the key's movement.

Experimentation has shown that a variety of methods (algorithms) are necessary to correct movement. For example, if the solenoid is too low, boosting the On Pulse that drives the solenoid 16 by a factor of its velocity is adequate. A Look-Up Table is adequate for this purpose. If the solenoid 16 is too high, the value of the acceleration and the key's momentum must be factored in, so the solenoid 16 must be shut off for a period of time (calculated by vector analysis) to eliminate the acceleration, and as a result, reduce the velocity.

Figure 11:
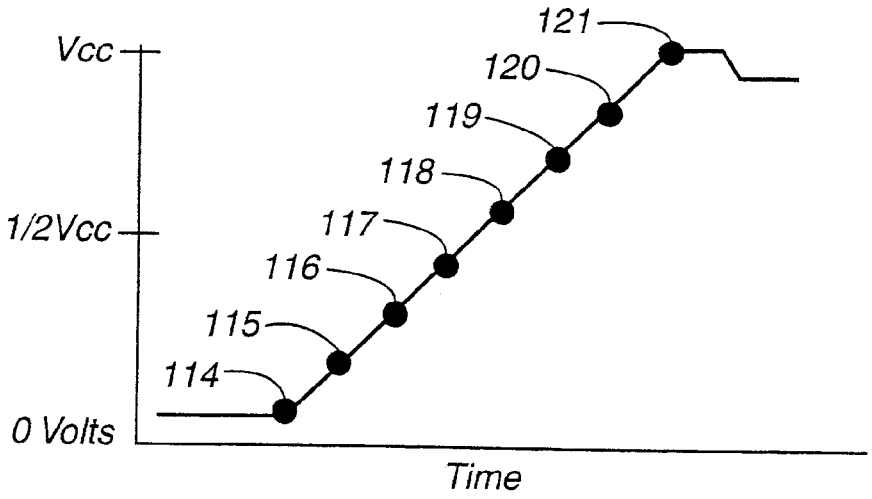
FIG. 11 is a graphical representation of the data points that can be placed on the sensor output to define the slope of the output.

As briefly noted above, MIDI velocities describe 128 different velocity levels. To describe the characteristics of each velocity in detail requires a large amount of data programmed into the DSP or microprocessor. As noted earlier, the response of the Hall Effect sensor (in Slide-by mode) is relatively linear. To reduce the data required, the response of the sensor 12 can be described as a set of data points on the sensor's output for that velocity. This is shown in FIG. 11. In this case, eight data point that describe a sensor's output for a given velocity. The slope of the line (described by the eight data points) determines the velocity. Values that need to be determined in between these data points can be calculated using a line interpolation algorithm.

Other sensor outputs (non-linear) can be approximated by a number of points that closely aligns with the curve. The more data points for a non-linear curve, the better the approximation. This is useful for a device that uses the Head-on approach to reading key movement which produces an exponential type curve. It is requested that the scope of this invention not be limited to one type of response, curved or linear, but that it pertains to the use of line interpolation algorithms to interpret the data along these responses.

As an example of the line interpolation in a linear response, a MIDI velocity of 30 (a medium soft note) takes the key about 140 milliseconds from start to finish as the key is slowly depressed. If the software were to monitor key movement in 1 millisecond intervals without line interpolation, this would mean that 140 data points would have to be stored in memory to calculate and evaluate each possible position. With 128 different velocities that have to be mapped out, this adds up to a sizable amount of memory required to store all the data points necessary.

Using line interpolation, the number of data points required to describe all 128 MIDI velocities is reduced dramatically. Referring to FIG. 11 again, we have described the velocity slope by data points at 114, 115, 116, 117, 118, 119, 120 and 121. With the exception of 114 and 121, the placement of the data points are completely arbitrary as long as the line between adjacent points adequately describe the shape of the slope, and any curvature that may exist. Data points 114 and 121 must exist at the beginning and end (respectively) of the slope, or at the very least, they define the limits of the area that will be used for calculations.

Figure 12:
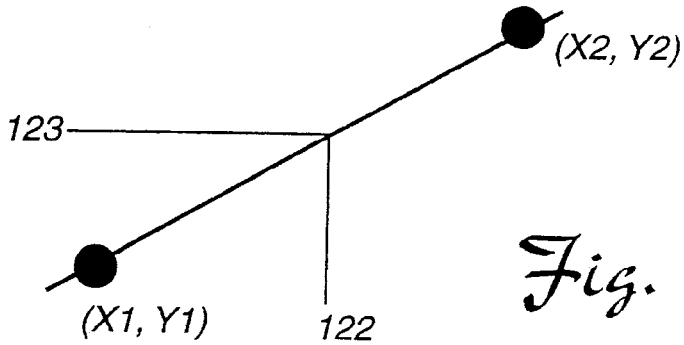
FIG. 12 is a graphical representation referencing how a data point in between two defined points can be calculated.

Referring to FIG. 11 again, and using MIDI velocity of 30 as an example, the data points could be placed 20 milliseconds apart. Data point 114 would be at the very start of key depression (0 milliseconds), data point 116 would be at 20 milliseconds, 116 would be at 40 milliseconds, and so on until data point 121 which is positioned at 140 milliseconds. To calculate points in between these defined points, a line interpolation algorithm is used. Referring to FIG. 12, a given time index 122 has no direct definition with the defined points. Instead, it ties in between data points (X1, Y1) and (X2, Y2). In our case, the X direction is time and the Y direction is the sensor reading values.

To determine the correct sensor reading 123 for time 122, the line interpolation algorithm uses the following formula to calculate the value:

$$123 = Y1 + ((122 - X1)/(X2 - X1)) \times (Y2 - Y1)$$

Or simply put:

Sensor value=Lower sensor value+(time ratio)+(difference between the two adjacent sensor values Processors, and in particular DSP processors, are particularly adept at doing these types of calculations using bit reversed addressing to quickly determine the two closest points (X1, Y1) and (X2, Y2) to the supplied value at 122. It is because of this reason that DSPs were selected for use in the preferred embodiment of this invention, though it should be noted that other processors including microprocessors can do the same function as well (though more slowly), and should not be excluded from the scope of this invention.

Figure 13:
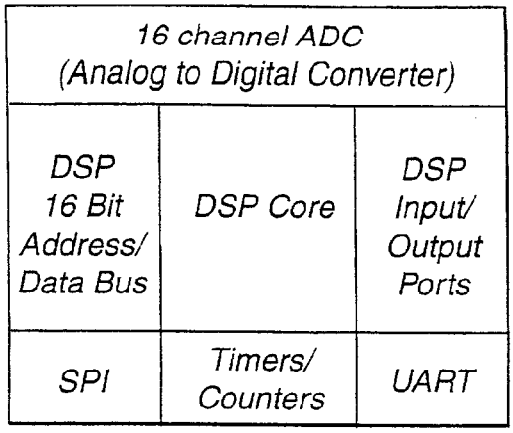
FIG. 13 is an illustrated overview of a Texas Instrument 320C240 DSP that is used as an example in this document.

The DSP used for this invention is Texas Instrument's TMS320C240 and TMS320F240 (the latter being Flash based ROM, which can be reprogrammed). An overview is shown in FIG. 13. The chip is a highly integrated 15 bit DSP with 16K ROM, a UART for serial (MIDI) communications, a SPI port for interfacing to other SPI devices such as an EEPROM, and 16 channels of Analog inputs to the Analog to Digital Converters (ADC).

Figure 14:
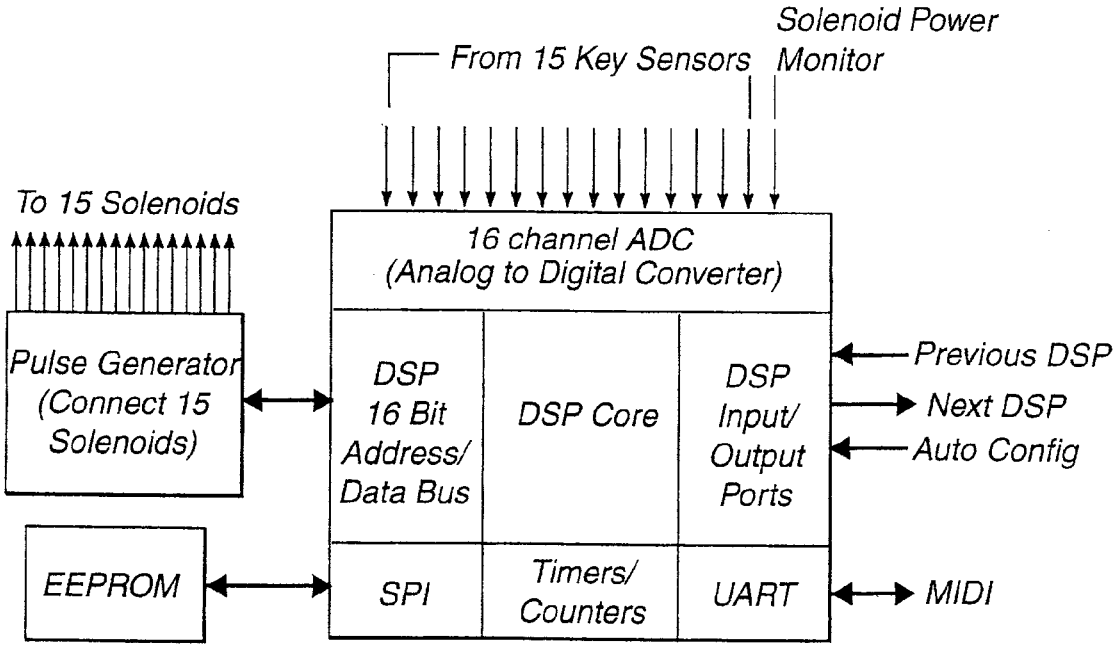
FIG. 14 is an illustration showing how a highly integrated DSP like the 320C240 can be used to perform a variety of control functions necessary to control a player mechanism.

An implementation overview of this device is shown in FIG. 14. Fifteen of the sixteen ADC channels are used to read 15 key sensors. In this case, the DSP can control or read 15 key positions at once. The sixteenth channel is reserved for monitoring the solenoid power supply, which helps detect if there is any problems with the high voltage that is used to drive the solenoids.

Although the TMS320C240 has internal Pulse Width Modulation circuits, these were not used for this application (to drive the solenoids), as there were not enough circuits for all 16 keys, and they were not flexible enough for application. Instead, an external 16 bit pulse generator was designed and used that directly attaches to the TMS320C240's Address and Data Bus.

An external EEPROM is used (attached to the SPI port) to store Sensor Calibration data. Two data points, V offset high and V offset low (FIG. 8), are stored for every sensor during calibration mode. These values are then read in on power-up and used to help normalize the sensor response, so that the line interpolation algorithm can correctly be used.

Also shown in FIG. 14 is the UART, which is used for MIDI communications, and some general purpose I/O ports which are used to communicate with other DSPs and help configure the system on power-up.

Figure 15:
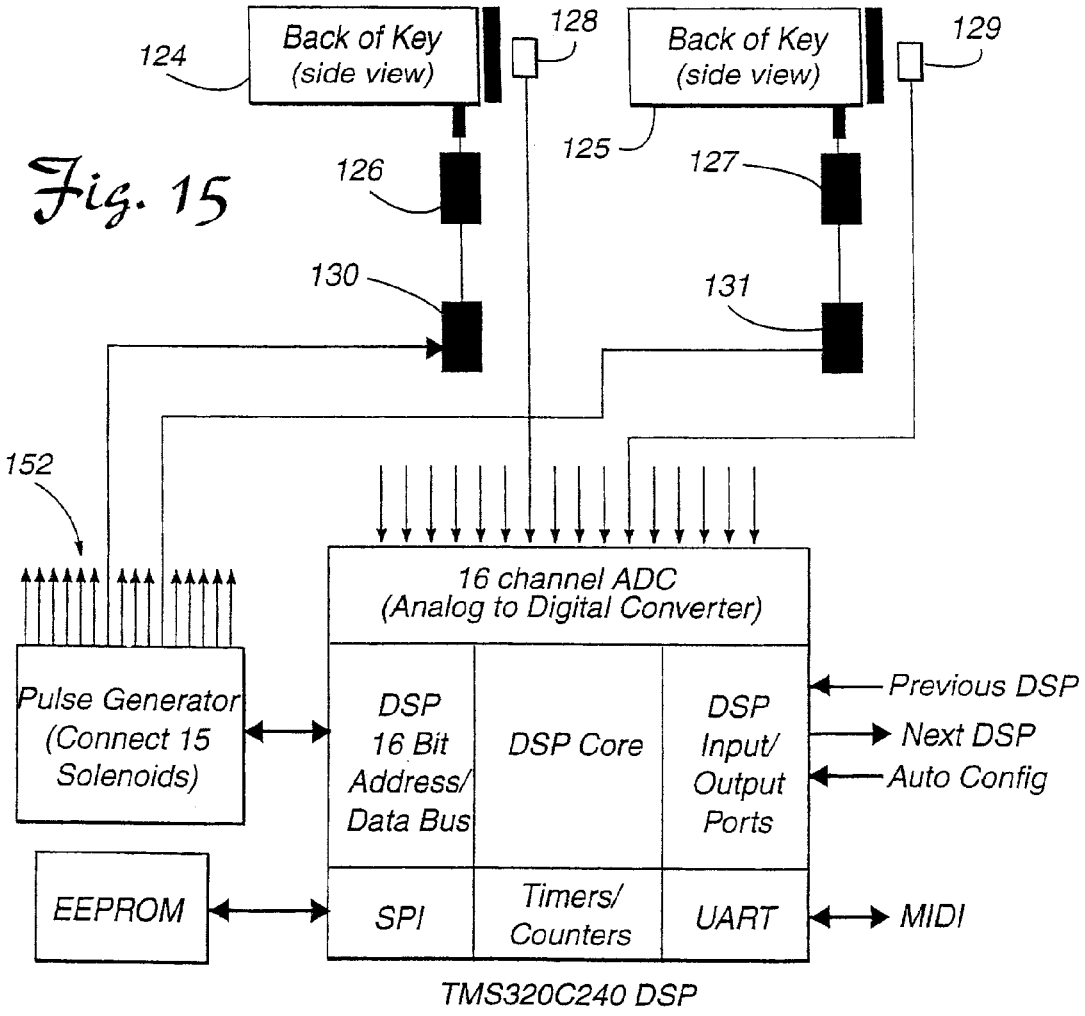
FIG. 15 is a block diagram schematic showing how a DSP can control both the record and playback modes concurrently.

Referring to FIG. 15 shows the system controlling two separate keys, with one key 124 in playback mode, and the other key 125 in record mode. Each key has its own sensor 128 and 129 to detect movements associated with that key. The output of the sensor is routed directly to the ADC on the DSP where it can be read and evaluated.

In the case of the key in playback mode 124, a MIDI command was received telling the DSP to play the note. The DSP in turn initializes the external Pulse Generator 132 that in turn controls the power transistor 130 that fires the solenoid.

For the key in record mode 125, the key's movement is detected with no control to the key's power transistor 131 or solenoid 127. In this case, the key's movement without control from the DSP is determined to be a key that is being played by the user, so it is automatically thrown into record mode.

Figure 16:
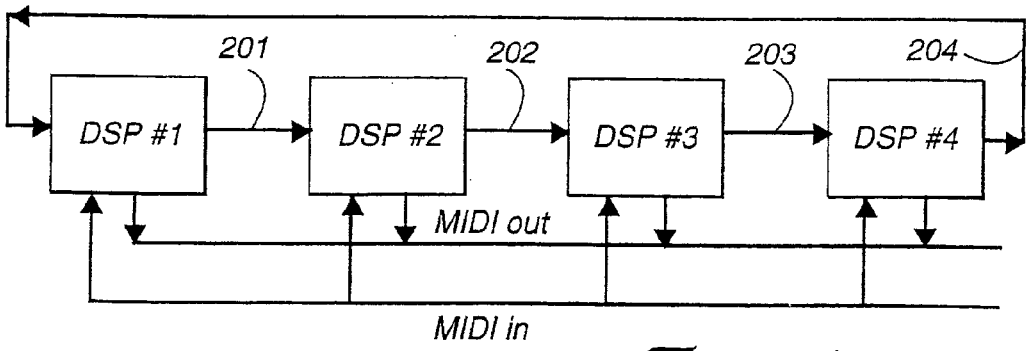
FIG. 16 is a block diagram showing an overview of one possible ring configuration necessary to utilized multiple processors to allow communication back to the external MIDI device.

In the example shown above, one DSP controls 15 keys. A typical piano has 88 keys, so to control all these keys, a total of 6 DSPs must be used in a piano. Each DSP is given a range of keys to control, so that it will not overlap with adjacent DSPs. For instance, referring to FIG. 16, DSP #1 would control keys 1–15, DSP #2 would control keys 16–30, DSP #3 would control keys 31–45 and DSP #4 would control keys 48–80. For a piano, two additional DSPs are needed, but for this purpose of explaining the system, the drawing was simplified to shown only 4 DSPs instead of the six required.

As each DSP knows which keys it has control of, receiving MIDI data is unique to each individual DSP. MIDI data contains the key number, so it is very simple for the DSP to calculate if the MIDI data being received is valid for that DSP. For instance, if DSP #1, which controls keys 1–15, receives a MIDI command for key 31, a simple compare statement in its code would determine that the command does not apply to itself. The processor DSP #3, which controls keys 31–45, though will determine that the command is valid and execute code accordingly to play the key.

For record, this system presents a problem. Each DSP knows its own key range, so transmitting MIDI data out for its keys is straightforward. However, if two keys that are controlled by two separate DSPs are recorded at the same time, the MIDI commands from both DSPs will collide with each other (both being transmitted at the same time).

To correct this situation, an approach commonly known as a token ring is used to allow each DSP a time as to when it can transmit data. In this invention, the token ring is initiated with DSP #1 (which contains the lowest notes on the keyboard). This DSP after determining that it has not MIDI data to transmit, sends a pulse 201 to the next DSP (#2) telling it that it is okay to transmit MIDI data if it has any to send out. DSP #2 upon receiving the pulse (token ring) now looks at its data and transmits out if there is any to send.

When all data is transmitted from DSP #2, this DSP then sends out a pulse 203 to the next DSP in line telling that processor (DSP #2) that it is now okay to send out information. DSP #2 in this case may not have any information to send, so it immediately sends out a pulse 203 to DSP 190 4 giving it permission to transmit data. When DSP #4 is finished with its transmission (if any) it sends out a pulse 204 that loops back to DSP #1, and the process is started all over. With each DSP having its own time slot to transmit data, there is no data collision on the shared MIDI transmit line.

Figure 17:
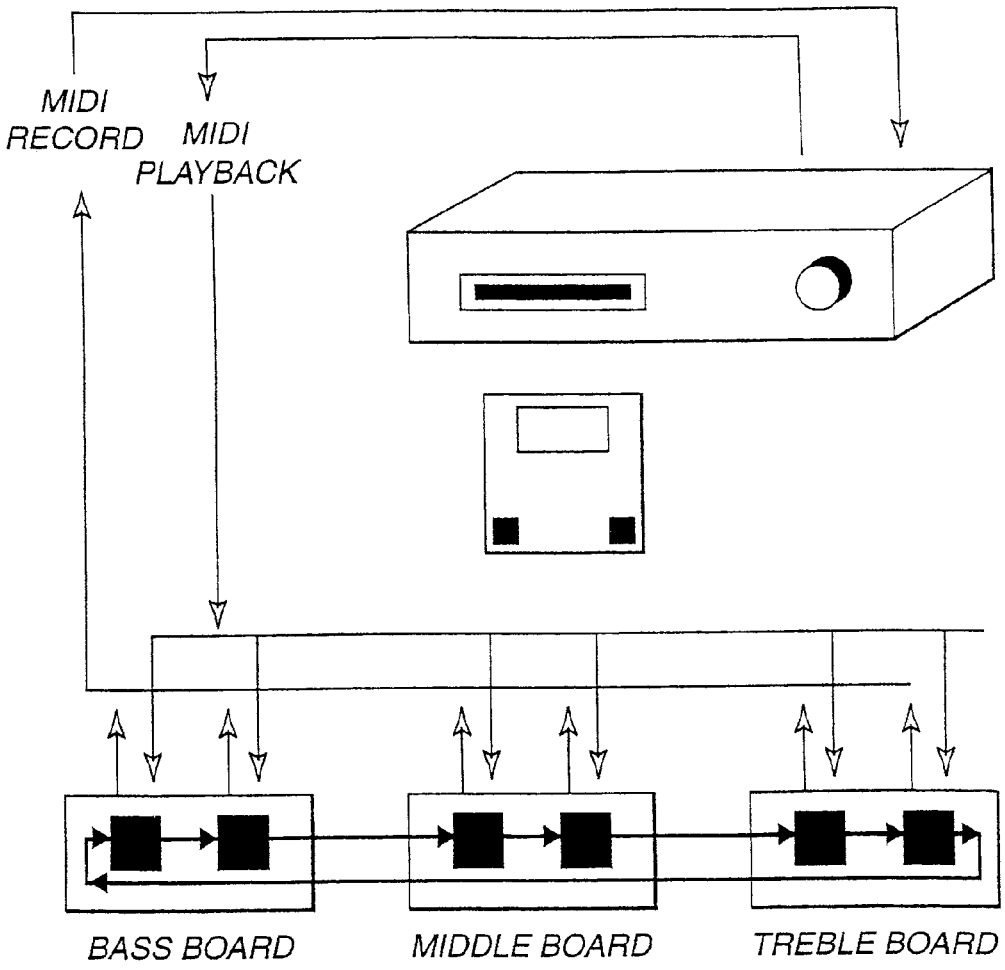
FIG. 17 is a broader overview of the MIDI handling between multiple processors, including the ring configuration and an external MIDI device.

Due to the high speed of the DSPs, the token ring is passed from DSP to DSP very quickly, and there is no deterioration in performance in regards to transmitting MIDI data. A full system with 6 DSPs (two on each board) is shown in FIG. 17. In this example, each board controls 30 notes, with each DSP controlling half of the boards 30 notes. The token ring is passed from one DSP to the next, until it is looped back after the sixth DSP finishes transmitting data. The common shared transmit line is then fed back to an external MIDI controller which can then save the data on a variety of media (RAM, floppy disk, compact discs, hard drive, etc.). Again, with playback, each DSP knows its own range of keys, so there are no problems sharing the same line with all other DSP controllers.

One additional piece of information can be sensed from the key's record mode. This is a feature call Aftertouch, and while common in electronic keyboards, it is rare in pianos. While it has no meaning directly for pianos, it is useful if the pianist is controlling an external MIDI device (i.e., synthesizer) from the piano. Aftertouch is achieved by pressing the key strongly after it has reached bottom. Some synthesizers can respond to this change and modify its sound upon receiving an Aftertouch command.

Figure 18:
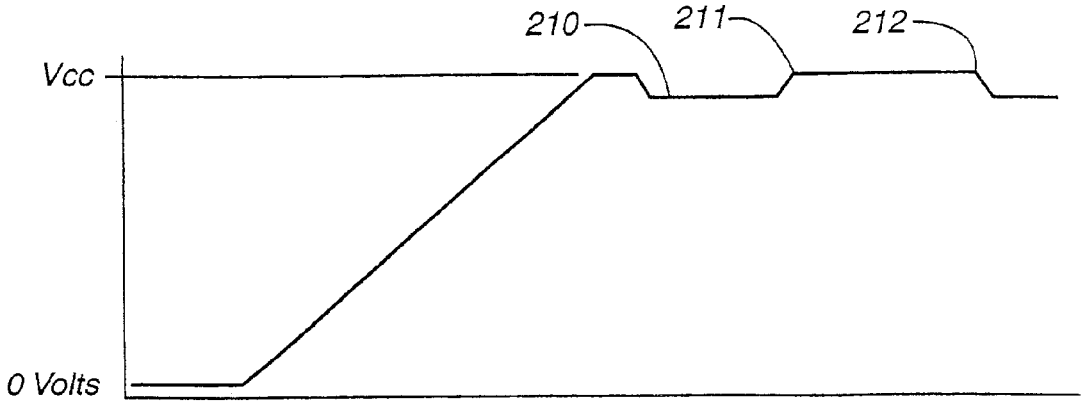
FIG. 18 is a graphical representation showing how the aftertouch can be detected during the backcheck mode.

In a piano, the key's travel downward is limited by a soft felt material directly under the key. This felt material can compress a millimeter or two if the key is pressed strongly. The effect on the sensor is measurable as shown in FIG. 18. The key, after its hammer strikes the string, enters the backcheck mode 210where the key is raised slightly. The sensor voltage is slightly reduced at this point. By looking at the voltage during this time, the DSP can determine if the key is being pressed harder 211 by a rise in the sensor's output—and maintained for at least 50 milliseconds before settling down 212 or being released completely. The 50 milliseconds check is necessary as when the key is released during playback (MIDI Note Off). The key's sensor output can also rise, but for a much shorter duration.

Referring to FIG. 18 shows the process that each DSP uses to test the keys, and how to determine the key's state (record or playback). The system was designed to allow automatic switching between record and playback modes, with each key being available for recording as long as it is currently not being played. It was determined that in order to avoid conflict between these two modes, record would take priority over playback.

An example of this would be if the user had pressed the key (and was still holding it down) when a MIDI Note On command was received for the same key. The Note On command cannot be processed as the key is already "on" or in use. In this case, turning on the solenoid to play the key makes no sense, so the MIDI Note On command must be disregarded and thrown away.

While this invention is playing keys, all other keys not being played are available for recording. This allows the user to play on top of an existing recording, with the MIDI data generated pertaining to only the notes that the user has played at the keyboard, not what the system is playing back from the external MIDI controller device. This dynamic key allocation is referred to as simultaneous play and record, and is a very useful tool for composers who build songs from chords, melodies or other individual components, allowing them to layer each component on top of one another, one at a time. This dynamic allocation between keys in play and record modes is one of the unique features of this system, and is part of the claims for this patent.

Referring to FIG. 19, power-up occurs at 300. The DSP goes through its own initialization and self-tests. Sensors are looked at to see if they are properly connected, and data is read in from the external EEPROM and saved internally. Some normalization calculations are done here to help speed up the routines that process the sensor data. Not shown here, but important is the lowest DSP in the system will go into a 25 millisecond delay (giving the other DSPs time to warm up) before initiating the first token ring. After the token ring is started, the process is automatic from that point on.

In the first implementation of this invention, an internal timer is set to generate an interrupt every 1 millisecond (1 ms). When this interrupt occurs, the DSP quickly analyzes the state of all 15 keys. Due to the unique architecture of the TMS320C240, all 15 key sensors can be analyzed with data normalization in less than 60 milliseconds (0.000060 seconds). This provides a very accurate snapshot of the key's movement at 1 millisecond intervals. This precise snapshot is necessary, as the data needs to be determined as close to the 1 millisecond interval as possible in order to work with the line interpolation routines, which are also recorded in 1 millisecond intervals. This constant 1 millisecond interrupt is also sometimes referred to as a system tick (or 1 ms tick).

Note that this invention is capable of running at other speeds, including sampling the keyboard at periods faster than 1 millisecond, but for the purpose of clearly explaining these concepts, the rate of 1 millisecond was chosen as an example. When a 1 ms tick occurs, the sensor data is analyzed, and the DSP looks at the various states of the keys and the data associated with those keys.

When not in the interrupt routine analyzing sensor data, the DSP monitors the MIDI buffer to see if any new commands have been received 301. If there is any data to transmit 302, or if the 1 ms tick has occurred 303.

If MIDI data has been received 301, then it is tested to see if the data applies to any of the keys that the DSP controls. If so, then a test is made to see if the key is available for playback 314 by testing the record mode for that key. If the key is in record mode, then the MIDI data is discarded (record takes priority), otherwise the data is stored in an internal MIDI buffer for not de-skewing and processing.

Note de-skewing is a process that aligns fast notes with slow notes, so all will play at the correct time. This is needed due to the mechanical nature of the piano. Unlike electronic keyboards which simply turn on an oscillator when a note occurs, pianos will play faster notes more quickly than slow notes as the keys move faster making the piano's key hammers strike sooner than should be. Note de-skewing simply realigns the faster notes, so they will sound the same time as the slow notes. Once the note has been in the buffer and its time de-skewed, it is then allowed to play.

If no MIDI commands have been received, then a check is made to see if the token ring 302 has arrived. If a token ring has arrived, the MIDI transmit buffer is checked to see if any data exists there. If data exists, then it is transmitted at this point, and the token ring is passed on to the next DSP. If there is no data to transmit, the token ring is immediately passed on.

Finally, a test for the 1 millisecond tick is made. If no such event has occurred, the problem loops back up to 301 and continues looking for tasks to do.

If a 1 millisecond tick has occurred, then a test is made 304 on all keys to see if they are moving on their own. If they are, then the key(s) are assigned as being in record mode.

For all the keys that the DSP controls, if the key is not moving on its own (being played by the user), then the key 305is compared to what was posted in the DSP's MIDI buffer. The buffer exists in two parts—one for de-skewing the notes before they are played, and the second for handling the time and sensor data while the note is being played.

If the key is in playback mode (and out of the note de-skewing buffer), the position is checked against the time that has elapsed since the start of playing the key. The sensor data is read in from memory (it was stored by the interrupt routine) and compared using the line interpolation algorithm to see if it is in the correct position. If the key is in the correct position, no action is taken, and the DSP continues onto the next key.

If correction is needed (and usually it does), the difference between the actual position and the proper position is calculated. At this point, a variety of algorithms can be called upon to correct the error. If the error is small, the solenoid's pulse can be amply increased (if too low) or decreased (if too high). When the key's position has a larger error, then other algorithms need to be used.

In this invention, the limits for error correction were arbitrarily set at 10% in either direction. If the solenoid exceeds this limit, then the DSP determines that something is seriously wrong, and shuts off all power to the solenoid. It then reports back to the external MIDI controlling device (via MIDI SysEx) about the situation. The most likely scenario for this condition is the solenoid overheating, but not to the point where it is seized up (frozen). By shutting down the solenoid until it cools off, the DSP avoids having the solenoid damaged by too much heat.

Finally, the DSP looks at the keys 306 to see which ones are in record mode and if limits have been reached 316 to where a MIDI Note On, or MIDI Note Off can be calculated and stored for transmission. The DSP has a buffer internally assigned for MIDI transmission and is capable of handling all notes simultaneously (if required) until the next token ring arrives.

The foregoing description of a preferred embodiment of the invention has been presented for purposes of illustration and description. It is not intended to be exhaustive or to limit the invention to the precise form disclosed. Obvious modifications or variations are possible in light of the above teachings. The preferred embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A key movement and velocity detector for use with a keyboard operated musical instrument having at least one key pivotally mounted thereto, comprising:

a magnet attached to a rear portion of said at least one key for movement upon actuation of said at least one key;

a magnetic sensor supported by the instrument adjacent said magnet for sensing changes in polarity of said magnet throughout movement of said magnet and producing an electrical signal corresponding to the sensed changes; and an electrical circuit for receiving said electrical signal produced by said magnetic sensor, determining a velocity of said at least one key, and applying a correction factor based on an initial actuation of the at least one key to said electrical signal or the determined velocity in a first mode of operation.

2. The keyboard operated musical instrument key movement and velocity detector of claim 1, in said magnet maintains a substantially constant distance from said magnetic sensor and the movement of said magnet is in a substantially vertical direction.

3. The keyboard operated musical instrument key movement and velocity detector of claim 2, wherein said sensor is positioned adjacent one side of said magnet to accommodate side-to-side movement of said at least one key.

4. The keyboard operated musical instrument key movement and velocity detector of claim 1, said electrical circuit comprises an analog to digital converter for converting said electrical signal, a processor for determining the velocity of said at least one key, and a machine readable storage media for recording the velocity of said at least one key.

5. The keyboar operated musical instrument key movement and velocity detector of claim 4, further comprising at least one additional processor connected to said first processor in a ring configuration.

6. The keyboard operated musical instrument key movement and velocity detector of claim 1, further comprising an actuation device positioned adjacent said rear portion of at least one key for actuating said key in a second mode of operation; and wherein said electrical circuit includes a plurality of processors for initiating said acruation device, receiving said electrical signal produced by said magnetic sensor, determining a velocity of said at least one key, and either recording said velocity of said at least one key for playback in said first mode of operation or adjusting said velocity of said at least one key during playback in a second mode of operation.

7. The keyboard operated musical instrument key movement and velocity detector of claim 1, further comprising an actuation device positioned adjacent said rear portion of said at least one key for actuating said key in a second mode of operation.

8. The keyboard operated musical instrument key movement and velocity detector of claim 7, wherein said electric circuit adjusts said velocity of said actuated key during playback in the second mode of operation.

9. A key movement and velocity monitoring and control system for a keyboard operated musical instrument, comprising:

at least one key pivotally mounted along a bottom surface of said at least one key to said instrument;

a magnet attached to a rear surface of said at least one key for movement upon actuation of said at least one key;

a magnetic sensor attached to said instrument adjacent said magnet for sensing changes in polarity of said magnet throughout the movement of said at least one key and producing an electrical signal corresponding to the movement;

an actuation device positioned adjacent a rear portion of said at least one key for actuating said key in a second mode of operation; and an electrical circuit for initiating said actuation device, and adjusting the actuation of said at least one key dependent upon a determined velocity of said at least one key, whereby pre-recorded music may be played back by the keyboard operated musical instrument independent of any possible effects of ambient conditions.

10. The key movement and velocity monitoring and control system of claim 9, wherein said actuation device is a solenoid which contacts said rear portion of said at least one key when actuated.

11. The key movement and velocity monitoring and control system of claim 10, wherein said magnet maintains a substantially constant distance from said magnetic sensor and the movement of said magnet is in a substantially vertical direction.

12. The key movement and velocity monitoring and control system of claim 9, wherein said electrical circuit comprises an analog to digital converter for converting said electrical signal, a processor for independently determining the movement and velocity of each of said at least one key and an adjustment factor for use in controlling said solenoid.

13. The key movement and velocity monitoring and control system of claim 9, herein at least two keys are pivotally mounted to said instrument; and further comprising at least one additional processor for independently determining the movement and velocity of said second key of said at least two keys, said at least one additional processor connected to said first processor in a ring configuration.

14. A method for monitoring and controlling a movement and velocity of at least one key of a keyboard operated musical instrument comprising the steps of:

positioning a magnetic sensor adjacent a magnet attached to a rear portion of the at least one key for monitoring the movement and velocity of said magnet and producing a corresponding electrical signal;

adjusting the corresponding electrical signal in accordance with a predetermined correction factor dependent upon the position of said magnet relative said sensor;

initiating the movement of said at least one key utilizing an actuation device;

comparing the movement and velocity of said magnet as embodied in said adjusted electrical signal to a desired movement and velocity; and adjusting the movement of said at least one key through said actuation device, whereby pre-recorded music may be played back by the keyboard operated musical instrument independent of any possible effects of ambient conditions.

15. The method for monitoring and controlling a movement and velocity of at least one key of a keyboard operated musical instrument of claim 14, wherein the comparing and adjusting steps are repeated throughout the movement of said at least one key.

16. A method for monitoring a movement and velocity of at least one key of a keyboard operated musical instrument comprising the steps of:

attaching a magnet to a rear portion of the at least one key;

positioning a magnetic sensor adjacent said magnet for monitoring changes in polarity caused by the movement of said magnet and producing a corresponding electrical signal;

initiating the movement of said at least one key;

receiving the corresponding electrical signal utilizing a processor;

adjusting the electrical signal dependent upon the position of said magnet relative said sensor; and recording the adjusted electrical signal corresponding to the movement and velocity of said at least one key utilizing a machine readable storage media.

17. The method for monitoring a movement and velocity of at least one key of a keyboard operated musical instrument of claim 16, further comprising initiating the movement of said at least one key utilizing an actuation device;

comparing the movement of said magnet to a desired movement as embodied in said adjusted electrical signal; and adjusting the movement of said at least one key throughout actuation.

18. A key movement and velocity monitoring and control system for a keyboard operated musical instrument, comprising:

at least one key pivotally mounted to said instrument, said key having a forward portion and a rear portion;

a magnet attached to said rear portion of said at least one key for movement upon actuation of said at least one key;

a magnetic sensor supported by said instrument adjacent said magnet for sensing the movement of said magnet and producing an electrical signal corresponding to the movement;

an actuation device positioned adjacent said rear portion of said at least one key for actuating said key in a second mode of operation; and an electrical circuit for initiating said actuation device, receiving said electrical signal produced by said magnetic sensor, determining the velocity of said at least one key throughout actuation, and adjusting the actuation of said at least one key dependent upon said determined velocity;

wherein said electrical circuit includes a plurality of processors for recording said velocity of said keys for playback in a first mode of operation and adjusting said velocity of said keys during playback in a second mode of operation, whereby pre-recorded music may be played back by the keyboard operated musical instrument independent of any possible effects of ambient conditions.

19. A keyboard operated musical instrument key motion sensing and recording apparatus, comprising:

a magnet attached to a rear surface of at least one key pivotally mounted to a bottom surface of said at least one key to a key bed supported by the instrument for movement upon actuation of the at least one key;

means attached to the instrument and facing said magnet for sensing changes in polarity of said magnet throughout the movement of the at least one key without contact and producing electrical signals corresponding to the sensed polarity of said magnet and indicative of key position; and means for receiving said electrical signals produced by said magnetic sensor and determining a velocity of said at least one key, whereby key movement and velocity data for said at least one key may be recorded.

* * * * *

UNITED STATES PATENT AND TRADEMARK OFFICE

CERTIFICATE OF CORRECTION

PATENT NO. : 6,472,589 B1
DATED : October 29, 2002
INVENTOR(S) : Charles Raymond Lee It is certified that error appears in the above-identified patent and that said Letters Patent is hereby corrected as shown below:

Column 13,
Line 46, change “keyboar” to -- keyboard --.

Column 14,
Line 44, change “herein” to -- wherein --.

Signed and Sealed this

Eighth Day of April, 2003

JAMES E. ROGAN
*Director of the United States Patent and Trademark Office*